US005887748A

United States Patent [19]

Nguyen

[11] Patent Number: 5,887,748

[45] Date of Patent: Mar. 30, 1999

[54] BAG SUPPORTING SYSTEM

[76] Inventor: Minh-Dang Son Nguyen, 1130 S. State College Rd., Anaheim, Calif. 92806

[21] Appl. No.: 917,316

[22] Filed: Aug. 25, 1997

[51] Int. Cl.[6] ..... B65D 1/06

[52] U.S. Cl. ..... 220/495.08; 220/908.1; 248/99

[58] Field of Search ..... 220/495.01, 495.06, 220/495.08, 908, 908.1; 248/95, 99

[56] References Cited

U.S. PATENT DOCUMENTS

| | | | |
|---|---|---|---|
| 3,402,848 | 9/1968 | Busey | 220/495.08 |
| 4,735,340 | 4/1988 | Preston | 220/908.1 |
| 4,750,638 | 6/1988 | Sosower | 220/908.1 |
| 4,763,808 | 8/1988 | Guhl et al. | 220/908.1 |
| 4,946,065 | 8/1990 | Goulter et al. | 220/908.1 |
| 5,671,861 | 9/1997 | Hall et al. | 220/495.08 |

*Primary Examiner*—Stephen Castellano

[57] ABSTRACT

In its broadest context, the present invention is a system which enables a minor receptacle to be positioned within a major receptacle. The system employs a pair of bag supports formed from a length of wire. Each of the bag supports has a pair of identical ends. Each end includes an anchor portion and a bag supporting portion. The bag supporting portion is defined by first and second angled extents which define first and second distances. The first distance is adapted to be positioned over the peripheral edge of the major receptacle while the second distance is adapted to receive the peripheral edge of the minor receptacle. In this fashion the minor receptacle is supported within the major receptacle.

4 Claims, 2 Drawing Sheets

BAG SUPPORTING SYSTEM

BACKGROUND OF THE INVENTION

1. Field of the Invention

The present invention relates to a receptacle supporting system and more particularly pertains to such a system which can be easily fitted onto an existing receptacle.

2. Description of the Prior Art

The use of a receptacles is known in the prior art. More specifically, receptacles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,332,361 to McCellan discloses a bag holder support system. U.S. Pat. No. 4,535,911 to Goulter discloses a trash container attachments for supporting plastic bags. U.S. Design Pat. No. 280,871 to Provan discloses a plastic bag holding rack. U.S. Pat. No. 4,925,056 to McColg discloses a apparatus facilitating the use of a plastic grocery bag as a trash container. U.S. Pat. No. 5,193,713 to Greathouse discloses a trash can conversion kit. Lastly, U.S. Pat. No. 4,418,835 to Watts discloses a trash container apparatus.

In this respect, the supporting system of the present invention substantially departs from the conventional concepts and designs of the prior art, and in so doing provides an apparatus primarily developed for the purpose of easily supporting a minor receptacle within a major receptacle.

Therefore, it can be appreciated that there exists a continuing need for receptacle supporting systems. In this regard, the present invention substantially fulfills this need.

SUMMARY OF THE INVENTION

In view of the foregoing disadvantages inherent in the known types of receptacle supporting systems now present in the prior art, the present invention provides an easy way to support a minor receptacle within a major receptacle. As such, the general purpose of the present invention, which will be described subsequently in greater detail, is to support a minor receptacle within a major receptacle wherein the peripheral edge of the minor receptacle is at a distance below the peripheral edge of the major receptacle.

To attain this, the present invention essentially comprises a system which enables a minor receptacle to be positioned within a major receptacle. The system employs a pair of bag supports formed from a length of wire. Each of the bag supports has a pair of identical ends. Each end includes an anchor portion and a bag supporting portion. The bag supporting portion is defined by first and second angled extents which define first and second distances. The first distance is adapted to be positioned over the peripheral edge of the major receptacle while the second distance is adapted to receive the peripheral edge of the minor receptacle. In this fashion the minor receptacle is supported within the major receptacle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bag supporting system. The system includes a major receptacle having a lower closed end and an upper opened end, with the opened end being defined by a peripheral edge. The system also includes a bag stand formed from a wire of uniform cross section,with the bag stand having two identical ends. Each end of the bag stand includes an anchor portion defined a first end, a second end and an intermediate extent therebetween. The intermediate extent is formed into a planar rectangular configuration. Additionally, each end of the bag stand further includes a bag supporting portion having a first end and a second end, with the first end of the bag supporting portion being integral with the second end of the anchor portion. The bag supporting portion is defined by an angled first extent which is elevated above the anchor portion by a first distance. Additionally, the bag supporting portion is further defined by an angled second extent which is integral with the angled first extent at an apex. The angled second extent is elevated above the angled first extent by a second distance. An interconnecting extent serves to connect the angled second extents of both ends of the bag stand. The minor receptacle has a closed lower end and an opened upper end,with the opened upper end being defined by a peripheral edge. The first distance of the bag stand is adapted to receive the peripheral edge of major receptacle to thereby secure the bag stand to the major receptacle. When secured, the apex of the bag supporting portion is positioned at a distance below the peripheral edge of the major receptacle. The second distance of the bag stand is adapted to receive the peripheral edge of the minor receptacle. Furthermore, a rubber coating is positioned over the entire extent of the bag stand to prevent the bag stand from damaging the major and minor receptacles.

It is another object of the present invention to provide a bag support that can be easily secured to any existing receptacle.

It is a further object of the present invention to provide a system wherein a minor receptacle is supported at a distance below the periphery of a major receptacle to ensure that the minor receptacle does not accidentally get deposited within the major receptacle.

An even further object of the present invention is to provide a receptacle supporting system which is susceptible of a low cost of manufacture with regard to both materials and labor, and which accordingly is then susceptible of low prices of sale to the consuming public, thereby making such supporting systems economically available to the buying public.

Still yet another object of the present invention is to provide a supporting system which provides in the apparatuses and methods of the prior art some of the advantages thereof, while simultaneously overcoming some of the disadvantages normally associated therewith.

Lastly, it is an object of the present invention to provide a new and improved receptacle supporting system which is simple to employ upon an existing container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
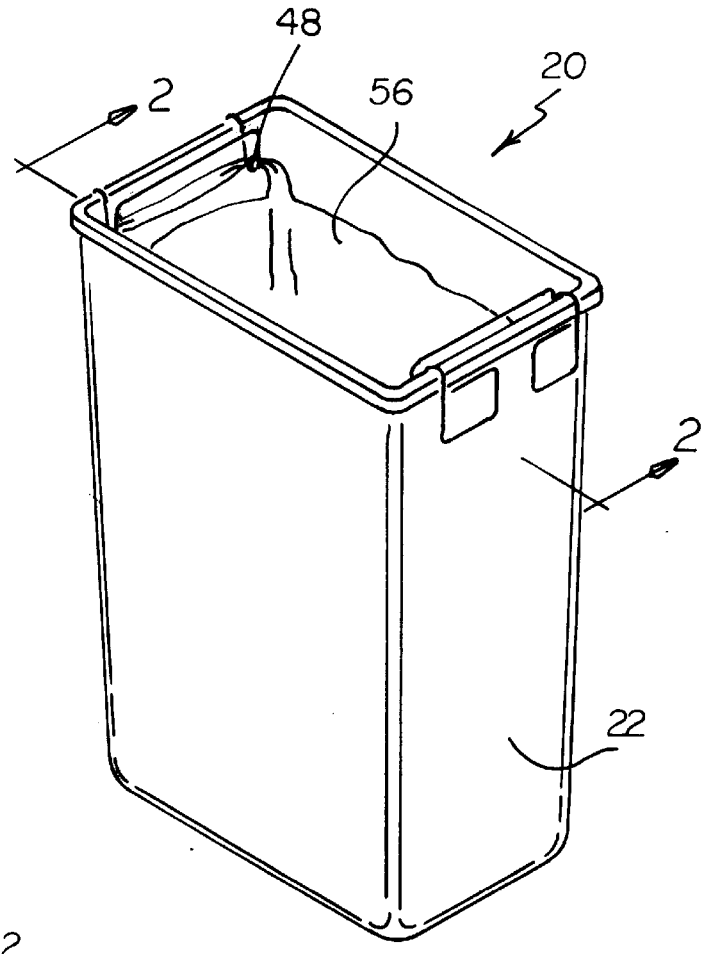
FIG. 1 is an illustration of the bag supporting system in use.

With reference now to the drawings, and in particular to FIG. 1 thereof, the bag supporting system 20 of the present invention is depicted. In its broadest context, the present invention is a system which enables a minor receptacle to be positioned within a major receptacle. The system employs a pair of bag supports formed from a length of wire. Each of the bag supports has a pair of identical ends. Each end includes an anchor portion and a bag supporting portion. The bag supporting portion is defined by first and second angled extents which define first and second distances. The first distance is adapted to be positioned over the peripheral edge of the major receptacle while the second distance is adapted to receive the peripheral edge of the minor receptacle. In this fashion the minor receptacle is supported within the major receptacle. The various components of the present invention, and the manner in which they interrelate, will be described in greater detail hereinafter.

The present invention finds particular application in conjunction with both a major and a minor receptacle. The major receptacle 22 is defined by a lower closed end and an upper opened end. The opened upper end is further defined by a peripheral edge. The minor receptacle 56 is likewise defined by a closed lower end and an opened upper end. Again, the opened upper end is defined by a peripheral edge.

The supporting system of the present invention also employs a par of bag stands 24. Each of these bag stands 24 is formed from a wire of a uniform cross section. Additionally, each of the bag stands 24 has two identical ends. Only one such bag stand 24 will be described in detail. Furthermore, since both ends of each bag stand are identical, only one end of one bag stand 24 will be described in detail.

Figure 3:
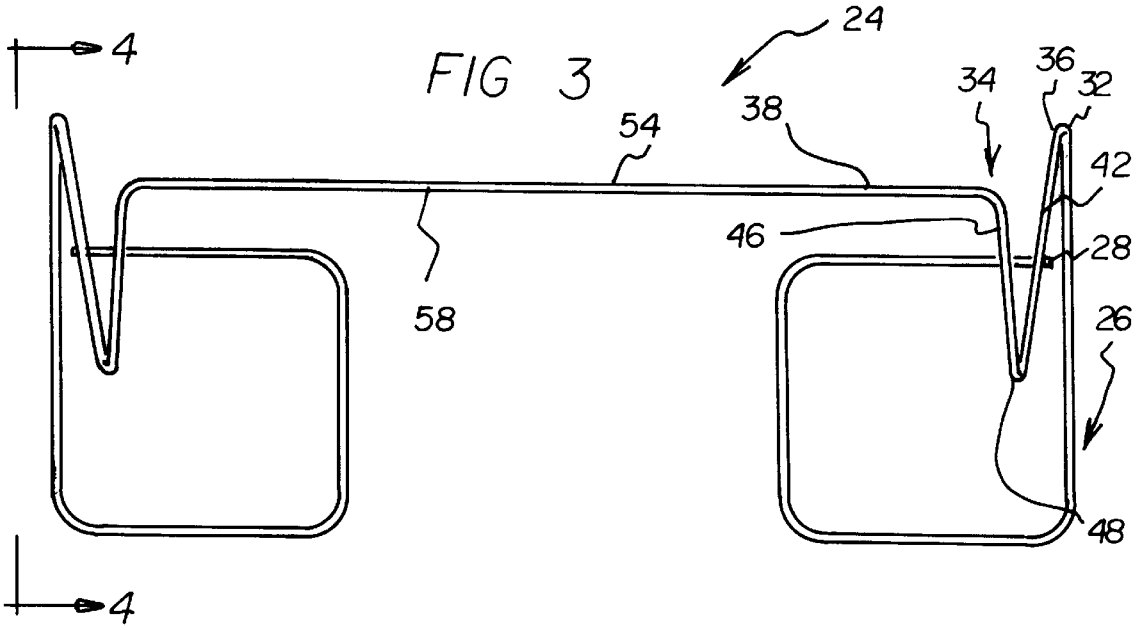
FIG. 3 is side elevational view of one bag support of the present invention.
Figure 4:
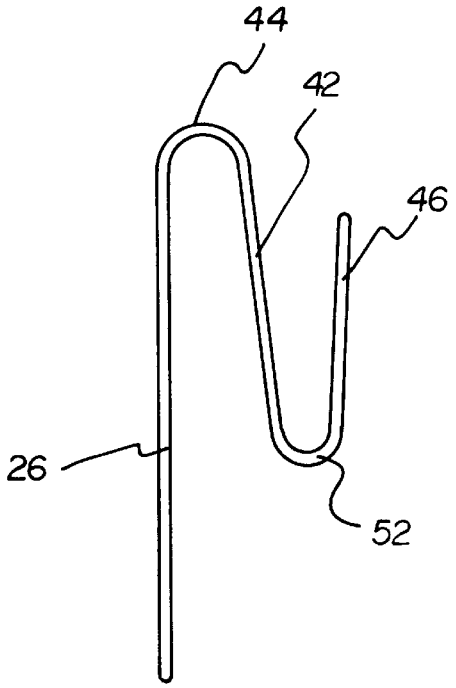
FIG. 4 is a view taken along line 4—4 of FIG. 3.

Each end of the bag stand 24 includes an anchor portion 26. The anchor portion 26 is defined a first end 28, a second end 32 and an intermediate extent therebetween. This intermediate extent is formed into a planar rectangular configuration. The geometry of the anchor portion 26 is depicted in reference to FIG. 3. Additionally, each end of the bag stand 24 includes a bag supporting portion 34. The bag supporting portion 34 includes a first end 36 and a second end 38, with the first end 36 of the bag supporting portion 34 being integral with the second end 32 of the anchor portion 26. The bag supporting portion 34 is defined by an angled first extent 42 which is elevated above the anchor portion 26 by a first distance 44. The bag supporting portion 34 is further defined by an angled second extent 46 which is integral with the angled first extent 42 at an apex 48. The angled second extent 46 is elevated above the angled first extent 42 by a second distance 52. The respective elevations of the first and second extents 42 and 46 respectively of the bag supporting portion 34, and the corresponding first and second distances 44 and 52 respectively, are best illustrated in reference to FIG. 4.

An interconnecting extent 54 serves to connect the angled second extents of both ends of the bag stand 24. Thus, the interconnecting extent 54 serves to connect the identical ends of the bag stand 24.

Figure 2:
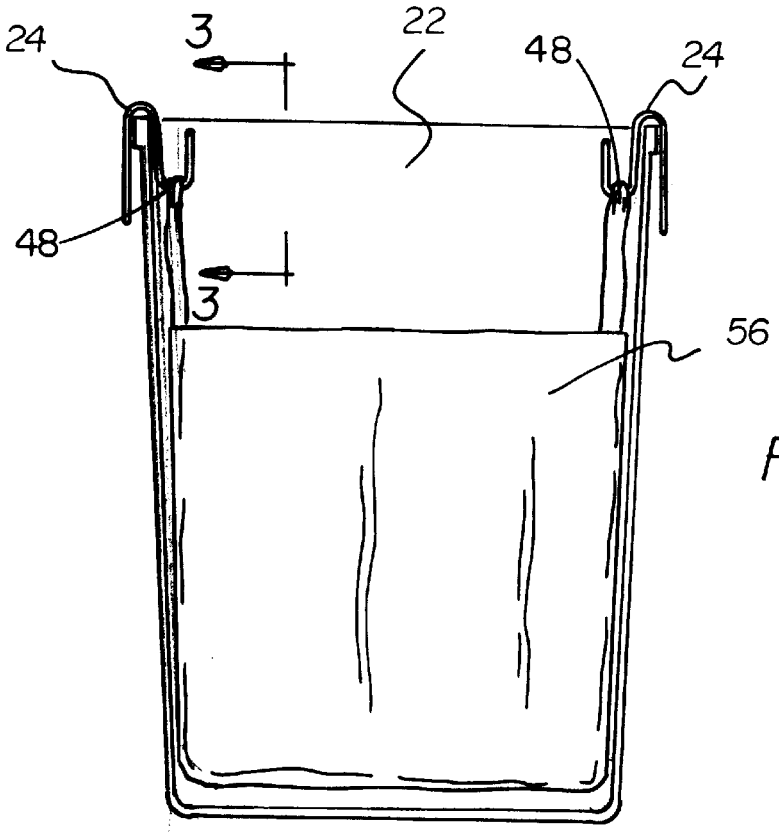
FIG. 2 is view taken along line 2—2 of FIG. 1.

The first distance of the bag stand is adapted to receive the peripheral edge of major receptacle to thereby secure the bag stand to the major receptacle. FIG. 2 illustrates the bag stand secured to the major receptacle. With continuing reference to FIG. 2, when secured the apex of the bag supporting portion is positioned at a distance below the peripheral edge of the major receptacle. Thus, when the system is in use the peripheral edge of the minor receptacle is positioned at a distance below the peripheral edge of the major receptacle. Such a configuration ensures that the minor receptacle is not accidentally deposited into the major receptacle. As illustrated in FIG. 2, the second distance of the bag stand is adapted to receive the peripheral edge of the minor receptacle. Additionally, in the preferred embodiment, a rubber coating 58 is positioned over the entire extent of the bag stand to prevent the bag stand from damaging the major and minor receptacles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bag supporting system comprising in combination:

a major receptacle having a lower closed end and an upper opened end, the opened end being defined by a peripheral edge;

a bag stand formed from a wire of uniform cross section, the bag stand having two identical ends;

each end of the bag stand including an anchor portion defined by first end, a second end and an intermediate extent therebetween, the intermediate extent being formed into a planar rectangular configuration;

each end of the bag stand further including a bag supporting portion having a first end and a second end, the first end of the bag supporting portion being integral with the second end of the anchor portion at a first apex, the bag supporting portion being defined by an angled first extent which is elevated above the anchor portion, the bag supporting portion further defined by an angled second extent which is integral with the angled first extent at a second apex, the angled second extent being elevated above the angled first extent;

an interconnecting extent connecting the angled second extents of both ends of the bag stand;

a minor receptacle having a closed lower end an opened upper end, the opened upper end being defined by a peripheral edge;

the first apex of the bag stand adapted to receive the peripheral edge of major receptacle to thereby secure the bag stand to the major receptacle, when secured the second apex of the bag supporting portion being positioned at a distance below the peripheral edge of the major receptacle, the second apex of the bag stand adapted to receive the peripheral edge of the minor receptacle;

a rubber coating positioned over the entire extent of the bag stand to prevent the bag stand from damaging the major and minor receptacles.

2. A bag supporting system comprising in combination:

a major receptacle having a lower closed end and an upper opened end, the opened end being defined by a peripheral edge;

a bag stand formed from a wire of uniform cross section, the bag stand having two identical ends;

each end of the bag stand including an anchor portion defined by first end, a second end and an intermediate extent therebetween;

each end of the bag stand further including a bag supporting portion having a first end and a second end, the first end of the bag supporting portion being integral with the second end of the anchor portion at a first apex, the bag supporting portion being defined by an angled first extent which is elevated above the anchor portion, the bag supporting portion further defined by an angled second extent which is integral with the angled first extent second apex, the angled second extent being elevated above the angled first extent;

an interconnecting extent connecting the angled second extents of both ends of the bag stand;

a minor receptacle having a closed lower end an opened upper end, the opened upper end being defined by a peripheral edge;

the first apex of the bag stand adapted to receive the peripheral edge of major receptacle to thereby secure the bag stand to the major receptacle, the second apex of the bag stand adapted to receive the peripheral edge of the minor receptacle; and wherein the intermediate extent of the anchor portion is formed into a planar rectangular configuration.

3. The bag supporting system as described in claim 2 further comprising:

a rubber coating positioned over the entire extent of the bag stand to prevent the bag stand from damaging the major and minor receptacles.

4. The bag supporting system as described in claim 2 wherein:

the apex of the bag supporting portion is positioned at a distance below the peripheral edge of the major receptacle when the bag support is secured to the major receptacle.

* * * * *